US012697530B1

(12) United States Patent
Emmert

(10) Patent No.: US 12,697,530 B1
(45) Date of Patent: Aug. 4, 2026

(54) STILT DEVICE WITH IMPROVED LEG ATTACHMENT ASSEMBLY

(71) Applicant: Emmert Second Limited Partnership, Oklahoma City, OK (US)

(72) Inventor: Raymond L. Emmert, Oklahoma City, OK (US)

(73) Assignee: Emmert Second Limited Partnership, Oklahoma City, OK (US)

( * ) Notice: Subject to any disclaimer, the term of this patent is extended or adjusted under 35 U.S.C. 154(b) by 0 days.

(21) Appl. No.: 19/392,260

(22) Filed: Nov. 18, 2025

(51) Int. Cl.
*A63B 25/00* (2006.01)

(52) U.S. Cl.
CPC ..... *A63B 25/00* (2013.01)

(58) Field of Classification Search
CPC ..... A63B 25/00
See application file for complete search history.

(56) References Cited

U.S. PATENT DOCUMENTS

| | | | | |
|---|---|---|---|---|
| 2,659,087 | A * | 11/1953 | Skaggs | A63B 25/00 482/75 |
| 5,645,515 | A * | 7/1997 | Armstrong | A63B 25/00 482/76 |
| 6,517,586 | B2 | 2/2003 | Lin | |
| 7,108,640 | B2 | 9/2006 | Emmert | |
| 7,744,509 | B1 * | 6/2010 | Emmert | A63B 21/023 482/75 |
| 7,780,581 | B1 * | 8/2010 | Emmert | A63B 25/10 135/65 |
| 8,172,730 | B2 | 5/2012 | Emmert | |
| 9,549,581 | B2 | 1/2017 | Rowland et al. | |
| 10,039,956 | B1 * | 8/2018 | Lin | A63B 25/00 |
| 10,293,241 | B2 | 5/2019 | Rodrick et al. | |
| 11,565,153 | B2 * | 1/2023 | Lin | A63B 25/06 |
| 11,602,672 | B2 | 3/2023 | Emmert | |
| D1,028,373 | S | 5/2024 | Emmert | |
| 12,121,774 | B2 | 10/2024 | Emmert | |
| 2003/0014001 | A1 | 1/2003 | Martin | |
| 2003/0203793 | A1 * | 10/2003 | Emmert | A63B 25/00 482/75 |
| 2006/0217241 | A1 | 9/2006 | Novara | |
| 2007/0027004 | A1 * | 2/2007 | Novara | A63B 25/00 482/75 |
| 2008/0096732 | A1 * | 4/2008 | Lin | A63B 25/00 24/191 |
| 2009/0165834 | A1 | 7/2009 | West | |
| 2010/0093501 | A1 | 4/2010 | Singleton | |

(Continued)

*Primary Examiner* — Zachary T Moore
(74) *Attorney, Agent, or Firm* — Hall Estill Law Firm

(57) ABSTRACT

A leg attachment assembly for a stilt of the type used to support a user above a base surface. A curved support plate threadingly receives a securement strap used to secure a leg of the user to a leg band of the stilt. A pair of retention walls extend upwardly from a convex outer surface to form an open strap retention channel that extends along the length of the plate. A channel body forms a closed strap retention channel aligned with the open strap retention channel to provide a threading path for the securement strap. The support plate can be slidingly positioned along the strap relative to a leg band of the stilt device. The leg band can also be pivotable and can include a channel body for sliding insertion of the securement strap. A cushioning pad can be affixed to a concave inner surface of the support plate.

22 Claims, 9 Drawing Sheets

(56) References Cited

U.S. PATENT DOCUMENTS

| | | | | |
|---|---|---|---|---|
| 2011/0130251 | A1* | 6/2011 | Emmert ..... | A63B 25/02<br>482/76 |
| 2011/0218466 | A1 | 9/2011 | Takahashi et al. | |
| 2016/0016307 | A1 | 1/2016 | Choi et al. | |
| 2022/0008281 | A1 | 1/2022 | Koenig et al. | |
| 2022/0193492 | A1* | 6/2022 | Emmert ..... | A63B 25/00 |

* cited by examiner

STILT DEVICE WITH IMPROVED LEG ATTACHMENT ASSEMBLY

BACKGROUND

Stilt devices allow a user to maneuver at an elevated height above a base surface. Such devices are often used in the construction industry to allow users to perform building or repair operations several feet above the ground and which could not otherwise be reachable without use of a scaffold or other support structure.

Stilt devices of the existing art are often configured with adjustable features to enable the stilts to conform to the body type, size and other requirements of the individual user. Of particular importance is the adjustability of the leg attachment aspects of the stilts, since these provide the interface between the stilts and the user. Ideally, a user should be able to stand and walk about on a pair of stilts with essentially the same security, comfort and control as if the user were directly walking on the underlying base support surface above which the user is raised.

While existing stilt devices have been found operable in this regard, there remains a continual need for improvements in stilt designs to enhance usefulness, safety and comfort for a user. It is to these and other improvements that various embodiments of the present disclosure are generally directed.

SUMMARY

Various embodiments of the present disclosure are generally directed to an improved stilt device that utilizes a novel and improved leg attachment assembly configuration. It is contemplated although not required that each stilt device will form a portion of a pair of stilt devices, one adapted to be attached and worn by the left leg of the user, and another adapted to be attached to and worn by the right leg of the user, with the respective left-side and right-side stilt devices being mirrored but otherwise identical.

Without limitation, some embodiments provide a leg attachment assembly for a stilt device of the type used to support a user above a base surface. A curved support plate threadingly receives a securement strap used to secure a leg of the user to a leg band of the stilt device. The curved support plate has a convex outer surface and an opposingly concave inner surface, and a pair of retention walls extend upwardly from the convex outer surface. The retention walls form an open strap retention channel that extends along the length of the curved support plate. At least one channel body is also provided on the convex outer surface, the channel body forming a closed strap retention channel. The closed strap retention channel is aligned with the open strap retention channel to provide a threading path for the securement strap as the strap is routed along the convex outer surface.

The support plate can be slidingly positioned along the strap relative to a leg band of the stilt device. The leg band is affixed to a leg support pole of the stilt device, and may be configured to be pivotable with respect to the leg support pole. The leg band can further be provided with a leg band channel body that defines another closed strap retention channel for sliding insertion of the securement strap. In this arrangement, the strap fully encircles the leg band and the support plate, and the leg band and the support plate cushioningly engages the leg of the user. Optionally, one or more cushioning pads of compliant material may be interposed between the support plate and the leg of the user.

These and other features and advantages which characterize various embodiments will be apparent from a reading of the following detailed description and a review of the associated drawings.

It will be understood that the various drawings are representative in nature and are not necessarily drawn to scale or with precise aspect ratios, etc. Nevertheless, the drawings are sufficiently clear and detailed to enable a full understanding of the disclosed subject matter.

DETAILED DESCRIPTION

Various embodiments of the present disclosure are generally directed to stilt devices of the type configured to enable a user to stand, walk and work at an elevated height above a base (e.g., floor) surface.

Figure 1:
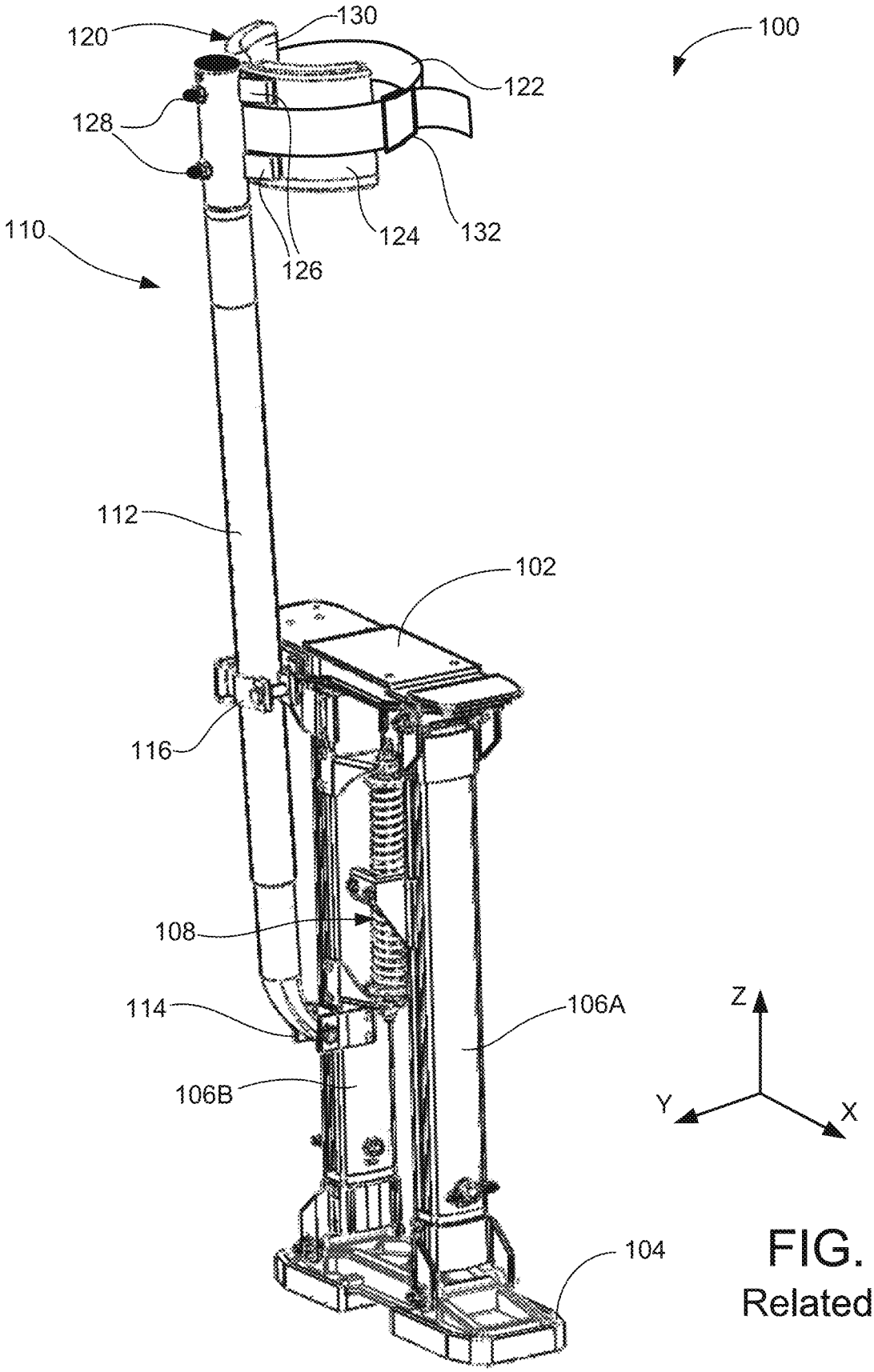
FIG. 1 Related Art
FIG. 1 is an isometric view of a stilt device of the related art to illustrate an operative environment in which various embodiments of the present disclosure can be advantageously practiced.

FIG. 1 shows a stilt device 100 of the related art to illustrate a general environment in which various embodiments can be advantageously practiced. It will be appreciated that FIG. 1 is merely exemplary and is not limiting, so that other forms of stilt devices can be used. The stilt device 100 is a right-side stilt for a pair of stilts to be worn by the user, with the other stilt in the pair of stilts being a mirrored, left-side stilt otherwise identical to the right-side stilt.

Orthogonal axes X, Y and Z are provided for reference. X aligns with the forward direction of travel of the user, Y extends to the side away from the center of mass of the user, and Z is the vertical direction above a floor or other support surface over which the user is elevated, with the floor surface extending along the X-Y plane.

The stilt device 100 includes a number of features including a foot (shoe) plate 102, floor plate 104, forward and rear struts 106A/106B, and a spring-biased damping assembly 108. The damping assembly 108 provides flexibility and cushioning to the user by permitting limited forward and rearward pivoting of the struts 106A/106B with respect to the foot plate 102 and the floor plate 104 as the user walks or moves. Although now shown in FIG. 1, foot straps are used to secure a footwear element (shoe, boot, etc.) of the user to the foot plate 102.

A leg attachment assembly 110 serves to support a portion of the user's leg just below the user's knee. The leg attachment assembly 110 has a telescopic leg support pole 112 that can be adjusted as desired to properly fit the user's leg length. The leg support pole 112 includes an inner sleeve and an outer sleeve, with the lower end of the inner sleeve attached to the rear strut 106B by a connector assembly 114. The length and angle of the leg support pole 112 can be adjusted and secured using a leg attachment clamp 116 adjacent the foot plate 102. The attachment clamp 116 engages a medial portion of the outer sleeve of the leg support pole 112.

The leg attachment assembly 110 further includes a leg attachment mechanism comprising a band member 120 and a securement strap 122. The band member 120, also referred to as a leg band, includes a curvilinearly extending, rigid support plate 124 formed of metal, plastic, or other suitable material. The support plate 124 is rigidly affixed to the support pole 112 via a pair of spaced-apart spacers 126 and threaded fasteners 128. Cushioning pads 130 in the form of foam blocks or similar are provided along an interior facing surface of the plate 124.

The securement strap 122 is formed of a durable, flexible material such as leather, nylon, woven cloth, etc., and is secured with a friction buckle 132. While not necessarily limiting, it is contemplated that the strap 122 encircles the user's leg and freely passes between the spacers 126 in the intervening gap between the plate 124 and the pole 112.

The stilt 100 is attached to the user's left leg by placing the outside of the user's right leg against the leg band 120, wrapping the strap 122 around the inner portion of the leg from one side to the other of the leg band 120, and tightening the buckle 132. In this way, the leg band 130 and strap 132 circumferentially extend around the user's right leg below the knee to secure the leg pole 122 to the user's right leg. A similar arrangement is used for the left-side stilt. In practice, the buckle 132 can be positioned at any suitable circumferential position about the user's leg as desired.

Figure 2:
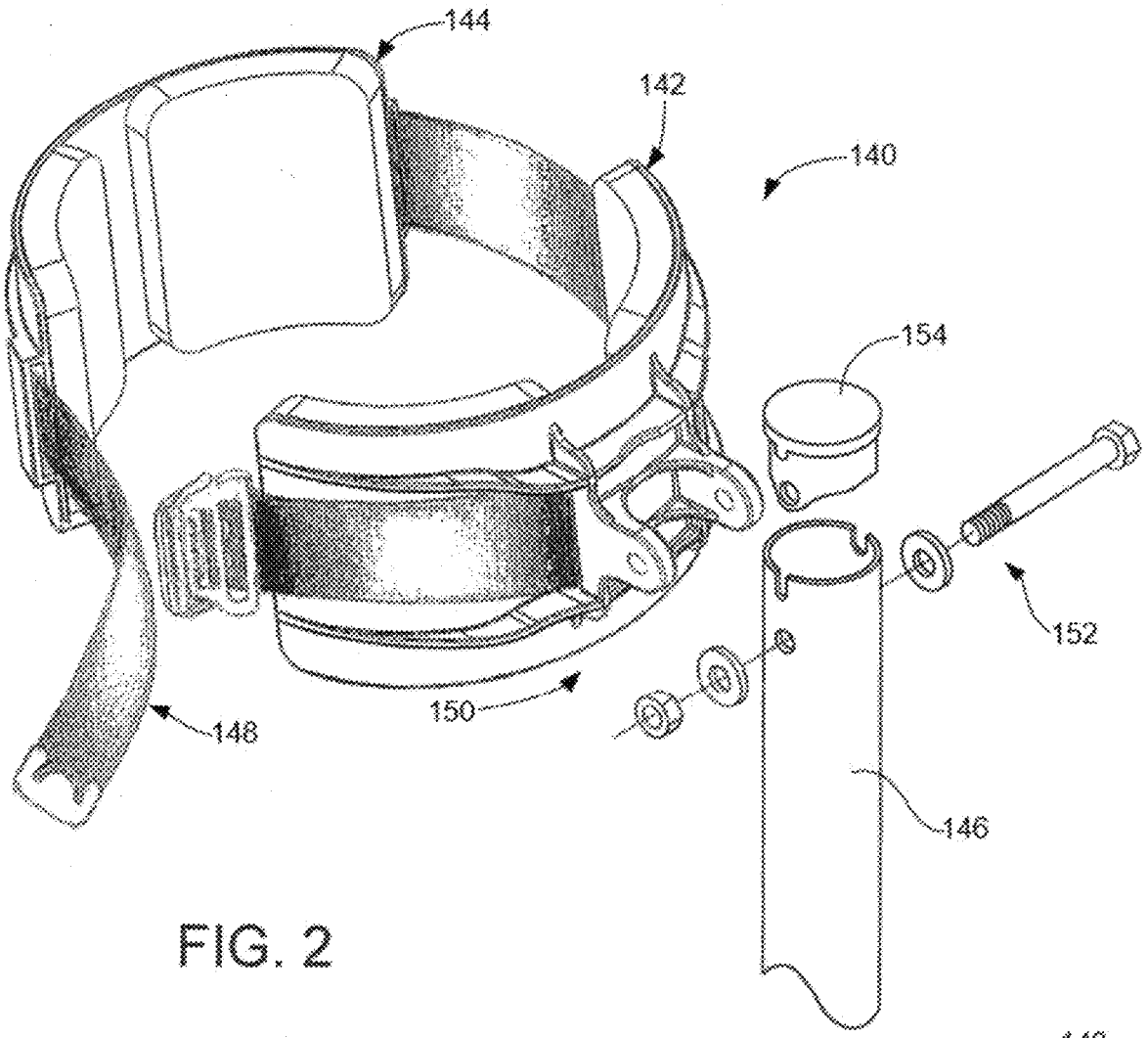
FIG. 2 is an exploded isometric depiction of a leg attachment assembly constructed and operated in accordance with various embodiments in a stilt device environment such as the type shown in FIG. 1.

FIG. 2 shows a leg attachment assembly 140 constructed and operated in accordance with various embodiments of the present disclosure. The leg attachment assembly 140, or aspects thereof, may be incorporated into the stilt device 100 in FIG. 1, or in other forms of stilt devices.

The leg attachment assembly 140 includes first and second support plates 142, 144, a leg support pole 146, and an encircling securement strap 148. The securement strap 148 is depicted more fully in FIG. 2A. Other configurations and combinations may be used, so the leg attachment assembly arrangement in FIG. 2 is merely exemplary and is not limiting.

The first support plate 142, also sometimes referred to as a leg band, is similar to the leg band 120 in FIG. 1, except the leg band 140 has certain additional features and capabilities not present in the leg band 120 as will be described herein. At this point it will be noted that the leg band 142 is coupled to the leg support pole 146 via a clevis bracket arrangement 150 that uses a threaded fastener arrangement 152 and a reinforcement cap insert 154. This clevis bracket arrangement allows limited rotational movement of the leg band 142 relative to the pole 146, while also facilitating sliding passage of the strap 148 between the leg band 142 and the pole 146.

The second support plate 144, also sometimes referred to as a comfort pad or support member, operates to threadingly receive and retain a section of the strap 148 during encirclement of the user's leg to enhance stability, comfort and control. As such, the support plate 144 can be used in conjunction with the leg band 140 as shown in FIG. 2, or the support plate 144 can be added as a single element to an existing stilt device such as the stilt device 100 in FIG. 1. For example, the support plate 144 can be threaded onto the strap 122 in FIG. 1 so that the user's leg is supported by the existing leg band 120 and the support plate 144. These and other alternative configurations are discussed in detail below.

Figure 2A:
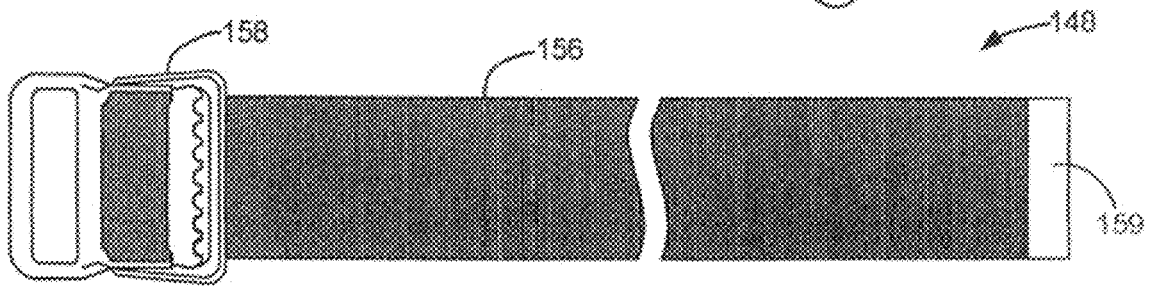
FIG. 2A shows a strap of the leg attachment assembly of FIG. 2 in some embodiments.

The securement strap 148 generally corresponds to the strap 122 in FIG. 1, although other configurations can be used. FIG. 2A shows the strap 148 to include an elongated, flexible web (belt portion) 156 and a metal friction buckle 158. The web 156 is a non-elastic, woven fabric with one end sewn or riveted to the buckle 158 and the other end enclosed in a metal retention tip 159. Other forms of straps can be used, including straps having buckle arrangements with plastic or metal engagement clips, etc.

Figure 3A:
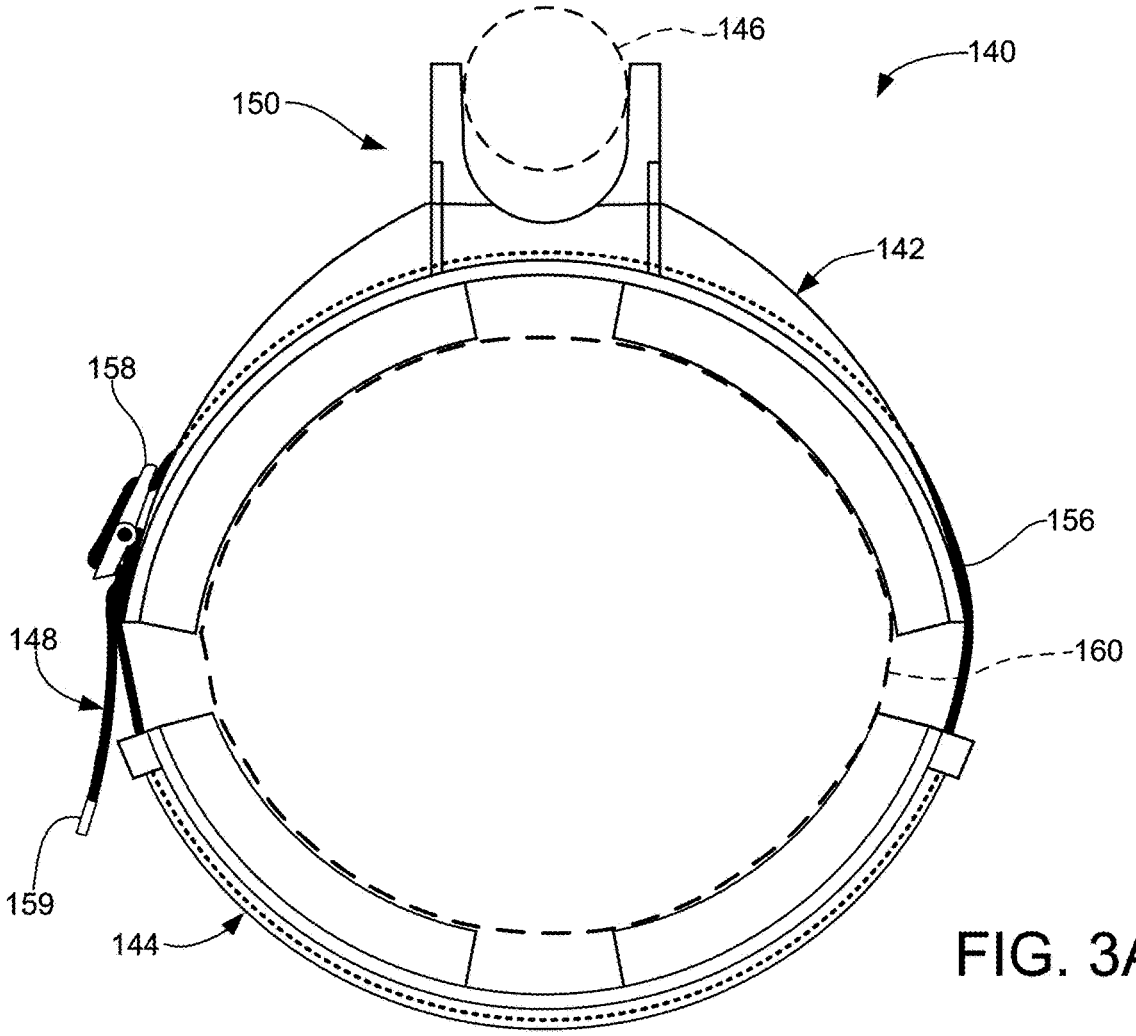
FIG. 3A is a top plan representation of the leg attachment assembly of FIG. 2 in some embodiments.
Figure 3B:
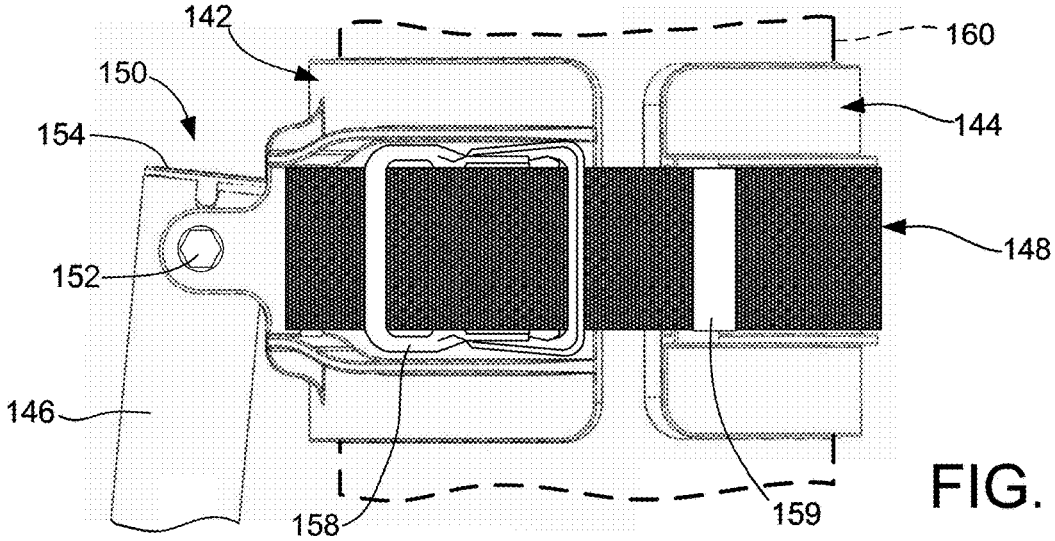
FIG. 3B is a side elevational representation of the assembly of FIG. 3A.

FIGS. 3A and 3B show aspects of the leg attachment assembly 140 of FIG. 2 in an attached configuration in which the assembly has been affixed to a user's leg (generally represented by dashed outline 160). The assembly 140 forms a clamshell type arrangement, with each of the leg band 142 and the support plate 144 contactingly engaging opposing sides of the user's leg 160.

The tensioned strap 148 fully encircles the user's leg without contactingly engaging the same, and compressingly maintains the leg band 142 and the support plate 144 against the user's leg. Because the leg band 142 and the support plate 144 are not otherwise attached together apart from the strap 148, the support plate 144 can be slidingly advanced or retracted along the strap 148 relative to the leg band 142 as required to provide an optimum support configuration for the user.

FIGS. 4A through 4E show the leg band 142 in greater detail. The leg band 142 includes a curved plate member 162 that has a convex outer surface 164 and a corresponding concave inner surface 166. The plate member 162 is formed of a suitable material such as injection molded plastic, metal, etc. While not limiting, in some embodiments the plate member 162 is substantially rigid, but is provided with a limited amount of flexibility to facilitate conformal engagement with the user's leg 160. One or more cushioning pads 168, such as in the form of foam blocks or other compliant material, can be optionally interposed between the leg band 142 and the user's leg 160, such as through adhesive bonding to the concave inner surface 166 (see FIG. 3A).

A bracket assembly 170 extends from a medial portion of the convex outer surface 164 of the plate member 162. The bracket assembly 170 includes a leg band channel body 172 that forms a closed strap retention channel 174 through which the strap 148 can be threadingly passed. While not limiting, the respective channel 174 and strap 148 are respectively sized to permit friction-based sliding retention of the strap. In this way, the user can advance the strap 148 through the channel 174 to establish a desired fastening orientation, and the strap will thereafter be retained in this position relative to the leg band after the strap has been subsequently unfastened.

Ear brackets 176, 178 extend upwardly from the leg band channel body 172 to facilitate passage of the fastener 152, and thereby secure the leg band 142 to the leg support pole 146 via the clevis bracket arrangement 150 (see FIGS. 2 and 3A-3B). Strengthening ribs 180, 182 project upwardly from the convex outer surface 164 and extend longitudinally from the channel body 172 towards opposing edges of the plate member 162 to enhance the rigidity of the leg band 142.

Figure 4A:
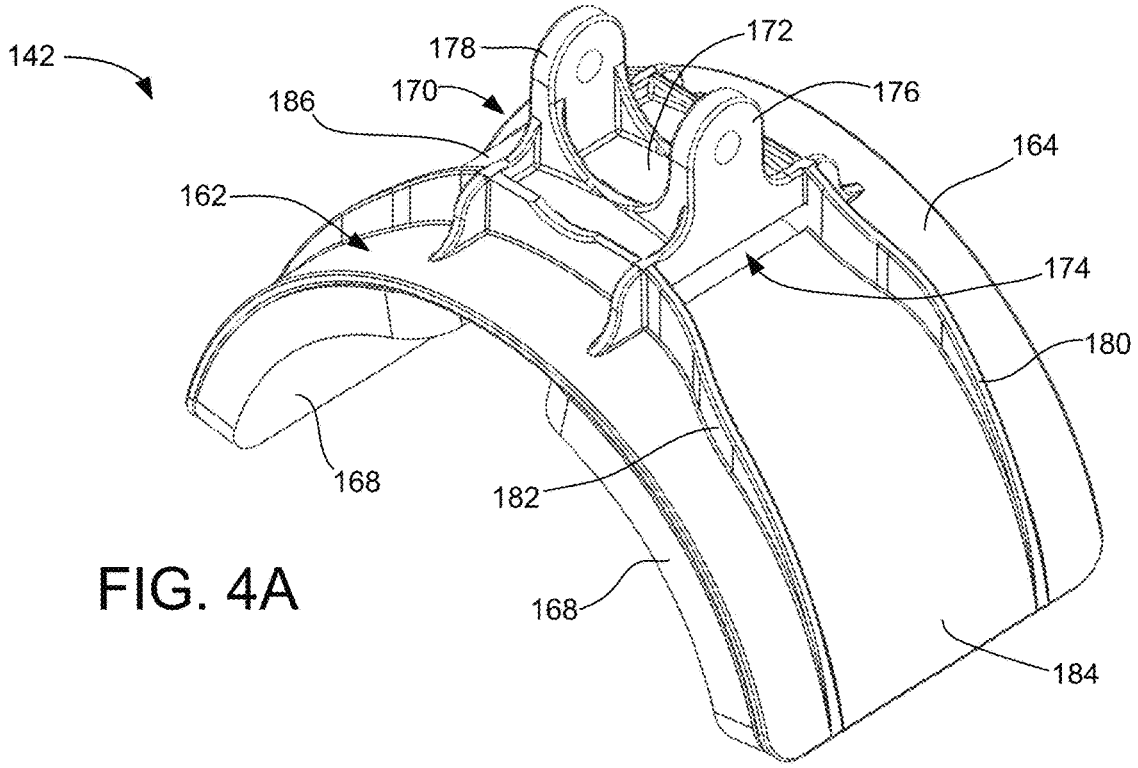
FIGS. 4A, 4B, 4C, 4D and 4E show various views of a leg band of the assembly of FIGS. 3A and 3B in accordance with some embodiments.
Figure 4B:
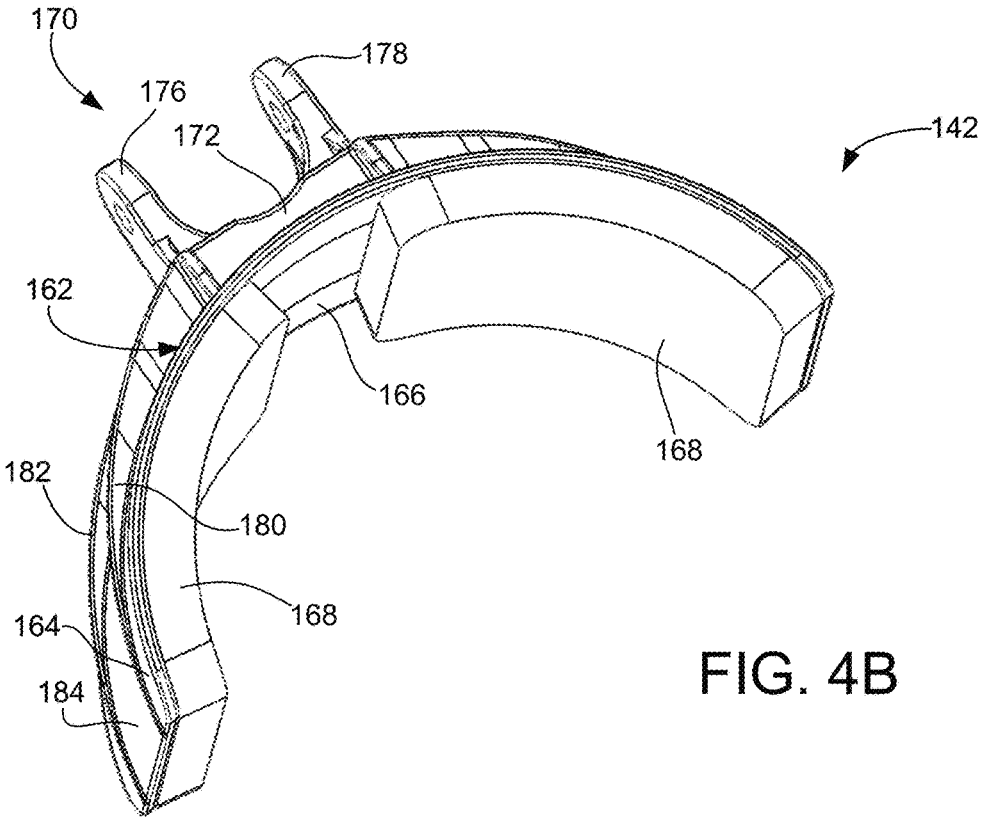
Figure 4C:
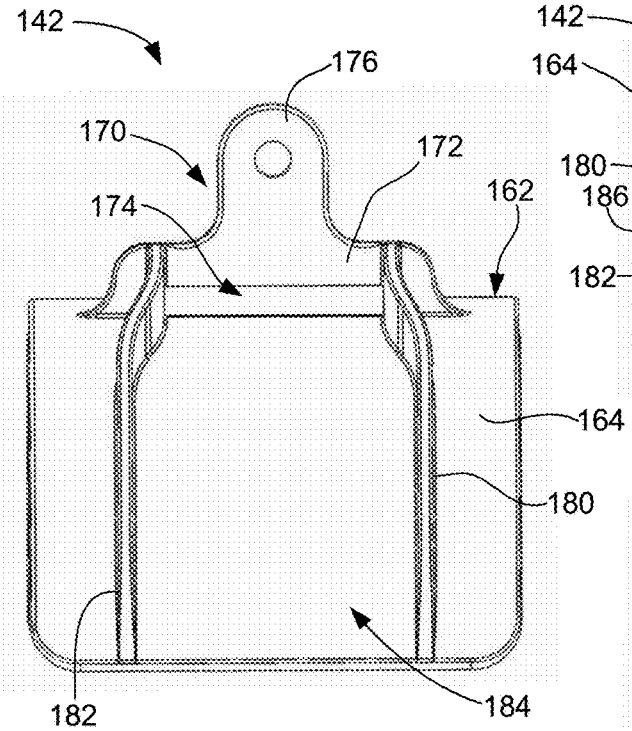
Figure 4D:
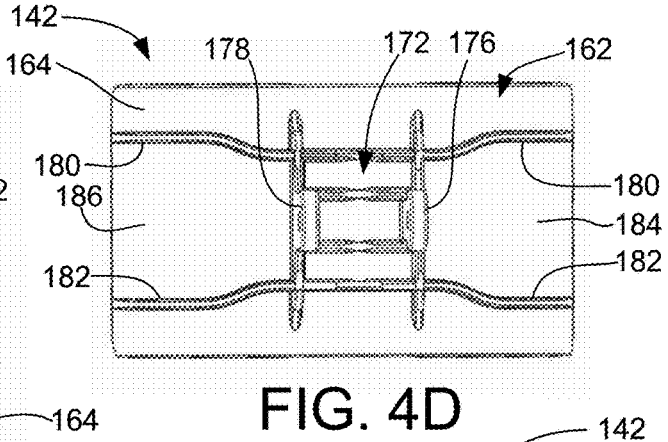
Figure 4E:
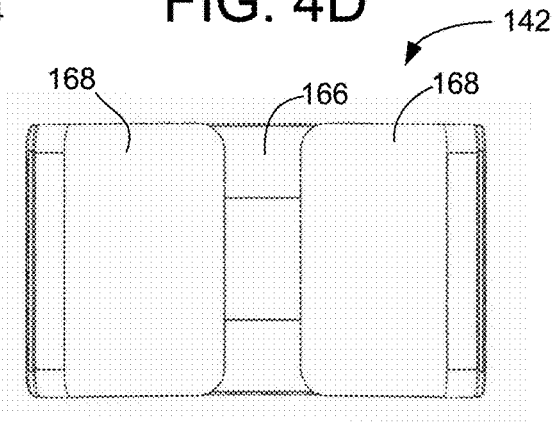

The ribs 180, 182, also referred to as retention walls, further serve as sidewalls to define a pair of open strap retention channels 184, 186 (best viewed in FIG. 4D). The open channels 184, 186 maintain centered positioning of the strap 148 against the convex outer surface 164.

For reference, the term "closed channel" and the like as used herein describes a channel configuration capable of retaining the strap relative to the underlying element irrespective of the securement condition of the strap, whereas the term "open channel" and the like as used herein retains the strap while the strap is secured (buckled) but allows lifting movement of the strap away from the underlying element when the strap is released (unbuckled). While not limiting, the closed channel 174 is configured as a box-like closed structure that at least partially encloses the strap with both opposing sidewalls and an overlying web portion, whereas the open channels 184, 186 are configured as u-shaped open structures formed by opposing sidewalls and the underlying plate to allow lifting removal of the strap. Other open and closed channel configurations are contemplated and will readily occur to the skilled artisan in view of the present disclosure.

The ribs 180, 182 diverge in non-parallel fashion so that the open strap retention channels 184, 186 are wider adjacent the edges of the plate member 162 as compared to the medial portion of the plate member 162 adjacent the channel body 172. This increased channel width near the edges of the plate member 162 accommodates the width of the buckle 158 and allows the strap 148 to lay substantially flat against the convex outer surface of the leg band 142, as shown in FIG. 3B.

Figure 5A:
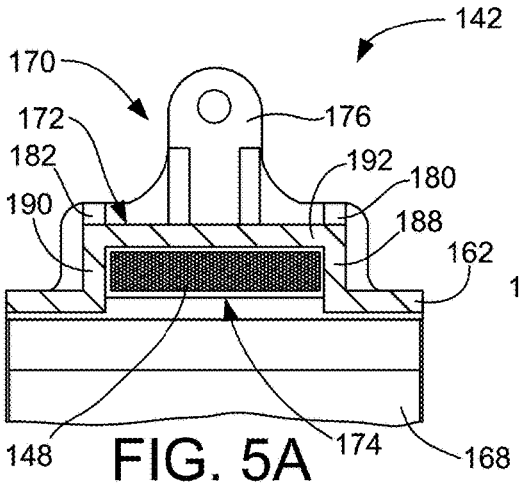
FIG. 5A provides an elevational, cross-sectional schematic view of the leg band in FIGS. 4A-4E in conjunction with the strap of FIG. 2A.
Figure 5C:
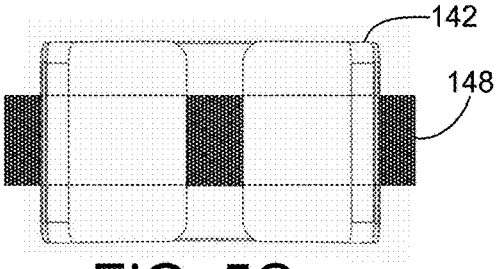
FIGS. 5B and 5C are respective top plan and bottom plan schematic views of the arrangement of FIG. 5A.
Figure 5B:
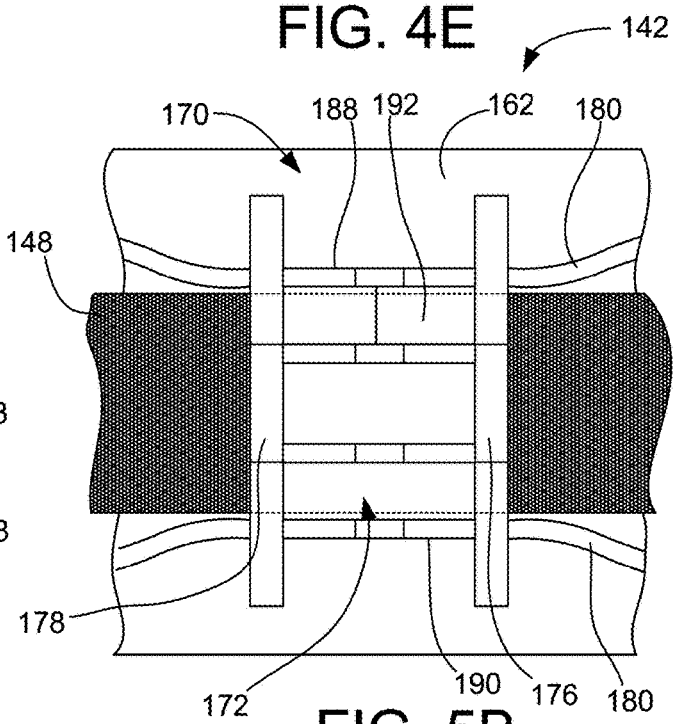
Figure 6A:
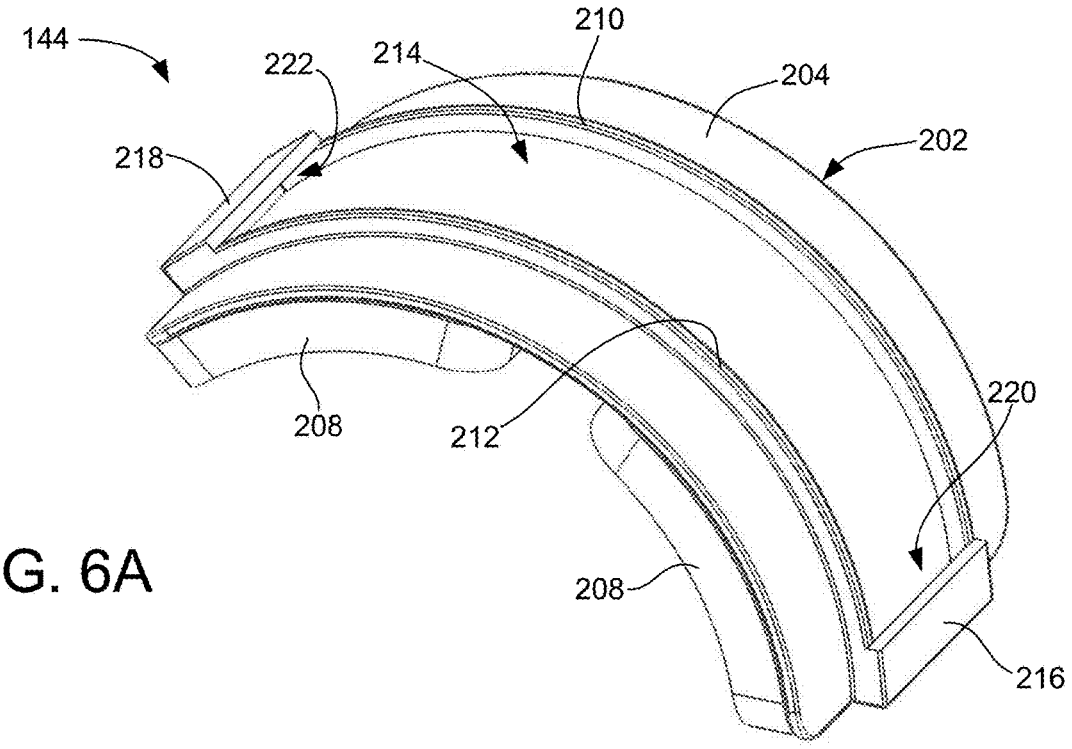
FIGS. 6A, 6B, 6C, 6D and 6E show various views of a support plate (comfort pad) of the assembly of FIGS. 3A and 3B in accordance with some embodiments.
Figure 6B:
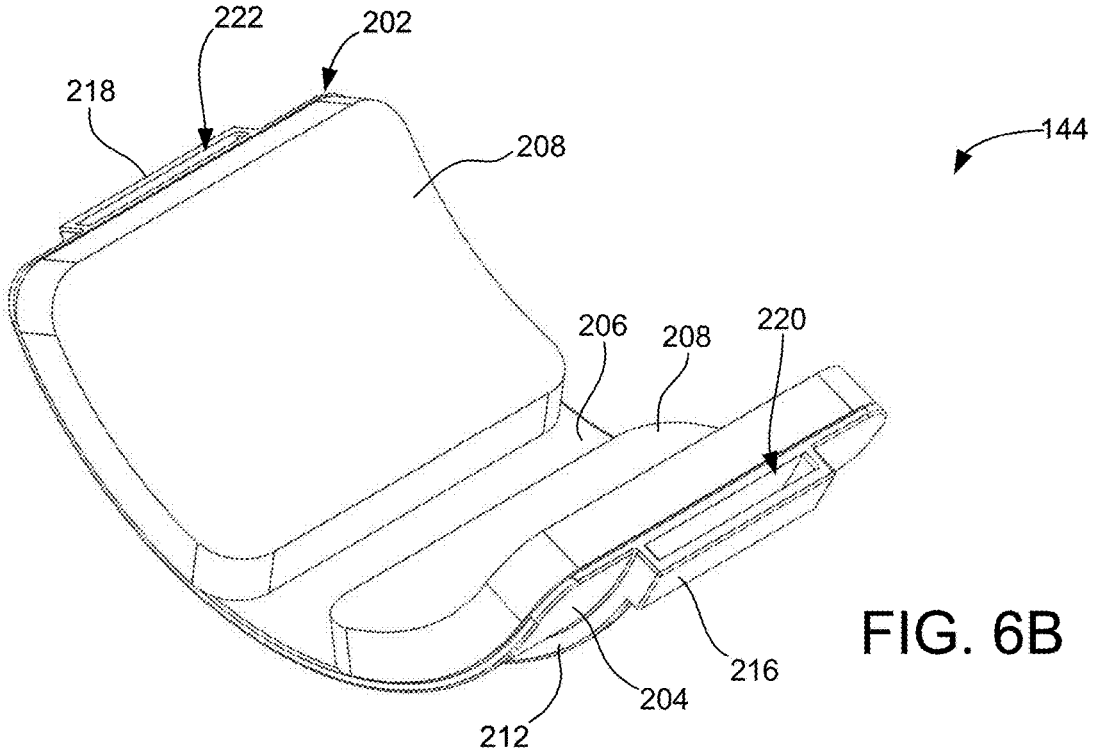
Figure 6C:
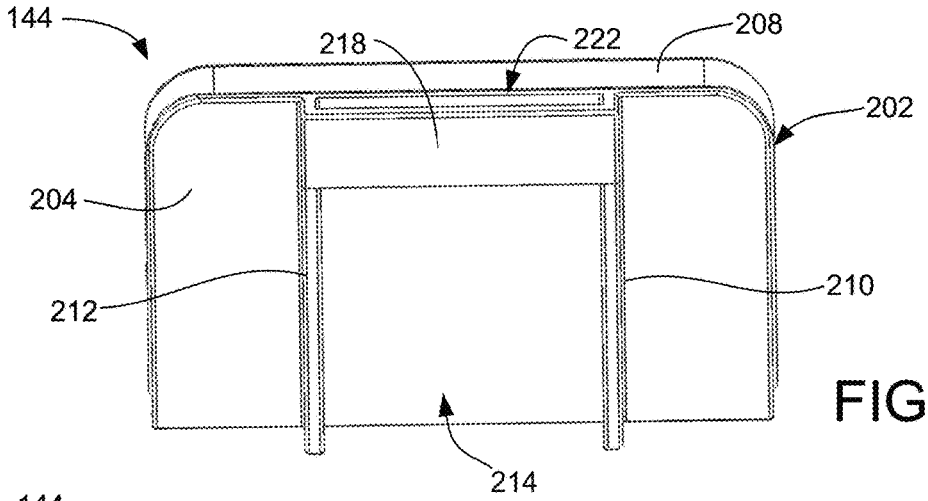
Figure 6D:
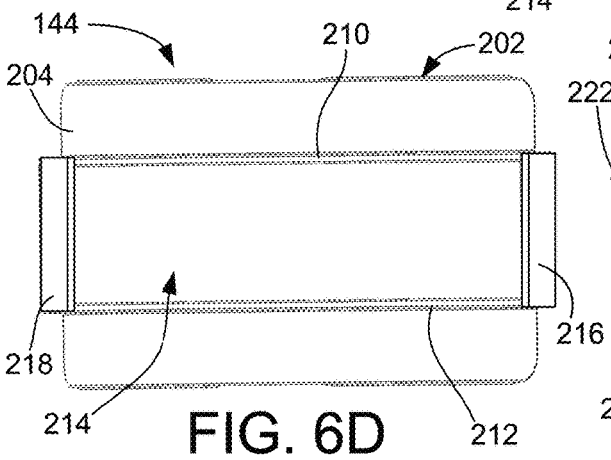
Figure 6E:
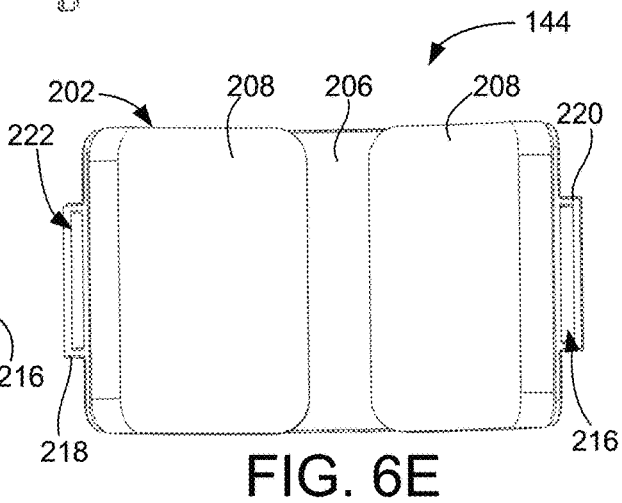

FIGS. 5A through 5C provide simplified sectioned views of the leg band 142 in accordance with further embodiments. FIG. 5A shows the channel body 172 to be formed by opposing, upwardly extending sidewalls 188, 190 and a transversely extending web portion 192 that spans the respective sidewalls 188, 190 to enclose the closed strap retention channel 174. While not necessarily required, the plate member 162 is open along the bottom of the channel 174 so that a portion of the strap is exposed to the interior side of the leg band (FIG. 5C).

The sidewalls 188, 190 can be aligned with and form a portion of the respective sidewalls 180, 182, or can be offset from these members. The transversely extending web portion 192 also serves as a base support for the ear brackets 176, 178.

FIGS. 6A through 6E show the support plate (comfort pad) 144 in greater detail. The support plate 144 includes a curved plate member 202 that has a convex outer surface 204 and an opposing concave inner surface 206. As before, the plate member 202 is formed of a suitable material such as injection molded plastic, metal, etc., and may be configured to be substantially rigid but retain a limited amount of flexibility.

Both the leg band 142 and the support plate 144 may be formed of the same material, or may be formed of different materials. Both the leg band 142 and support plate 144 may have the same or similar height and length dimensions. As best viewed in FIG. 3A, both the leg band 142 and the support plate share a common radii of curvature, but the support plate 144 has a slightly shorter circumferential length as compared to the leg band 142.

As before, one or more cushioning pads 208 may be interposed between the support plate 144 and the user's leg. While optional, the cushioning pads further facilitate conformance to and support of the user's leg, and may be formed from foam blocks or other compliant material. The pads 208 may be separate elements that are inserted into the space between the support plate 144 and the leg by the user during installation of the stilt, or may be adhesively bonded to the concave inner surface 206 to form a permanent part of the overall assembly. Other arrangements are contemplated, so the use of adhesively affixed foam blocks as shown at 208 is merely exemplary and is not limiting.

A pair of strengthening ribs 210, 212 extend upwardly from the convex outer surface 204 in spaced-apart, parallel fashion. The ribs 210, 212 serve to enhance the rigidity of the plate member 202, and also function as retention walls (sidewalls) to define at least one open strap retention channel 214 with the underlying convex outer surface 204 to retain the strap 148. The sidewalls 210, 212 are shown to extend substantially over an entirety of the convex outer surface 204, but this is merely exemplary and is not limiting as other lengths and placements for the sidewalls are contemplated, as discussed below.

A first support plate channel body 216 is disposed at a first edge of the support plate 144, and a second support plate channel body 218 is disposed at an opposing second edge of the support plate 144. Each of the support plate channel bodies 216, 218 provides a box-like closed structure to define a respective closed strap retention channel 220, 222.

Figure 7A:
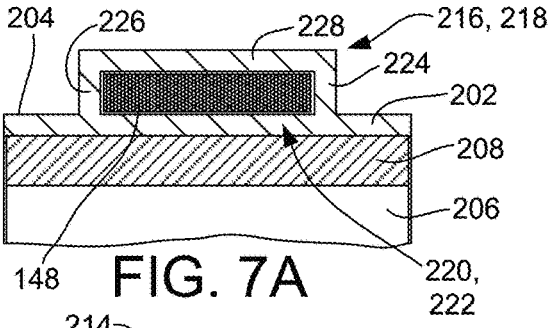
FIGS. 7A and 7B provide elevational, cross-sectional schematic views of the support plate in FIGS. 6A-6E in conjunction with the strap of FIG. 2A.
Figure 7B:
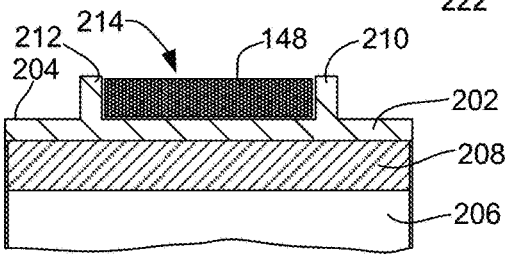
Figure 7C:
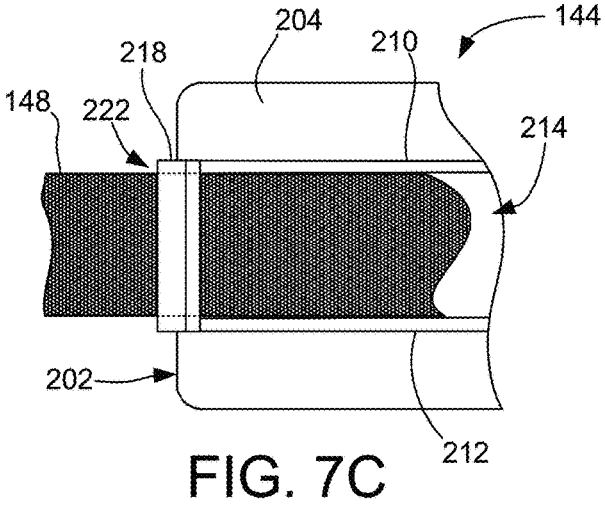
FIG. 7C is a top plan schematic view of the arrangements of FIGS. 7A and 7B.

As further shown in FIG. 7A, each support plate channel body 216, 218 includes opposing retention sidewalls 224, 226 that extend upwardly from the convex outer surface 204 and which are at least partially enclosed by a transversely extending web portion 228 to form the associated closed strap retention channel 220, 222 adjacent a selected one of the first or second edges. Each of the closed channels 220, 222 is aligned with the open channel 214 (FIG. 7B) to provide an elongated strap routing path for the strap 148 along the outer convex surface 204 of the support plate 144 (FIG. 7C). The sidewalls 210, 212 of the open channel 214 may be coextensive with the sidewalls 224, 226 of each of the closed channels 220, 222, or may be separate elements.

As before, the respective dimensions of the support plate channel bodies 216, 218 and the strap 148 may be selected to provide a friction-based sliding retention of the support plate 144 on the strap 148. In this way, the user can adjust the desired position of the support plate 144 along the strap, and this relative position will be maintained after the strap has been unbuckled. Moreover, the retention of the support plate on the strap will ensure the support plate remains with the stilts when the stilts are set aside during periods of non-use.

While the support plate 144 is shown in this particular arrangement to have two opposing closed channels 220, 222 at the respective ends of a single centrally disposed open channel 214, other arrangements are contemplated and can be used, including different respective numbers and arrangements of the open and closed channels along the convex outer surface 204 of the support plate 144.

Figure 8A:
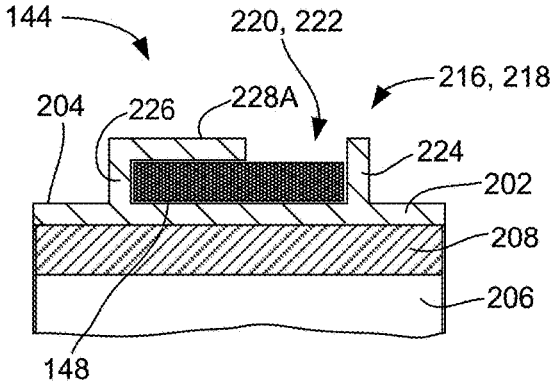
FIGS. 8A and 8B show alternative configurations for a channel body of the support plate in further embodiments.
Figure 8B:
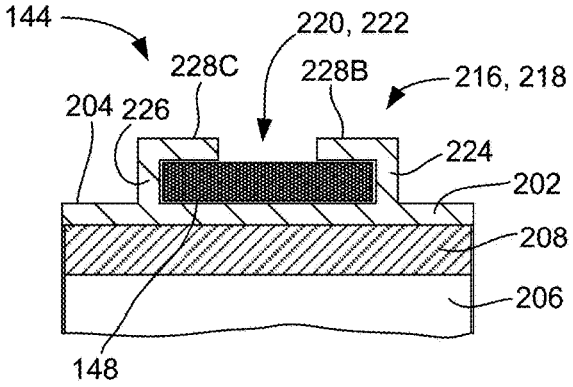

FIGS. 8A and 8B show alternative configurations for the support plate 144 in accordance with further embodiments. Like reference numerals have been used for similar components that have been previously discussed. In FIG. 8A, at least one or both of the channel bodies 216, 218 remains a closed channel in that the respective channel is formed from upwardly extending sidewalls 224, 226 and a transversely extending web portion 228A that extends between the sidewalls 224, 226, as before.

In this case, however, the transversely extending web portion 228A projects from one of the sidewalls (in this case, sidewall 226) but does not fully span the channel 220, 222 to adjoin the other sidewall (in this case, sidewall 224). Nevertheless, the web portion 228A extends a sufficient lateral distance to retain the strap 148 within the closed channel 220, 222 so that FIG. 8A is also a closed channel configuration. In this case, the web portion 228A spans nominally 50% of the overall distance between the sidewalls 224, 226, but other spanning distances greater or less than 50% of the overall distance can be used as desired.

FIG. 8B shows another closed channel configuration in which one or both of the channel bodies 216, 218 uses a pair of transversely extending web portions 228B, 228C, each respectively extending from an associated sidewall 224, 226 to span a portion of the overall distance across the closed channel 220, 222. As before, the total amount of the overall distance spanned by the web portions 228B, 228C is nominally 50%, but other spanning distances greater or less than 50% can be used as desired.

Figure 9A:
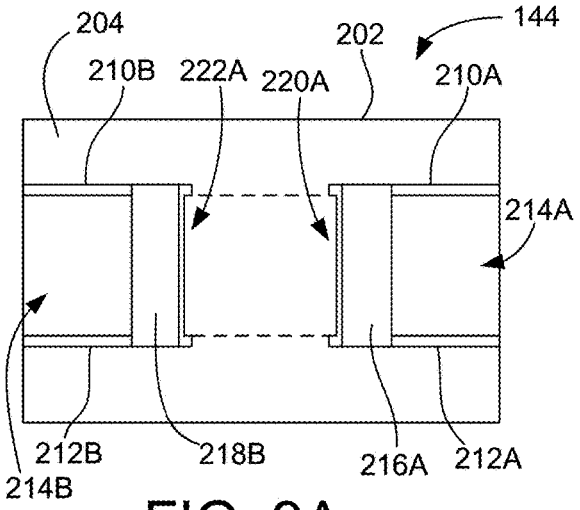
FIGS. 9A and 9B show further alternative configurations for the support plate in further embodiments.
Figure 9B:
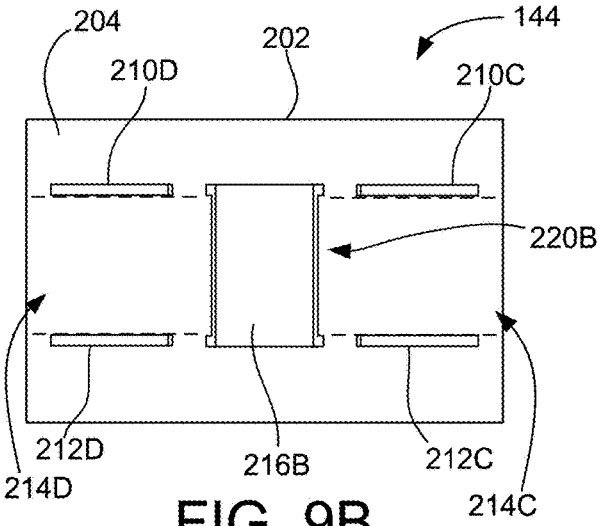

FIGS. 9A and 9B show further alternative configurations for the support plate 144 to illustrate different numbers, arrangements and combinations of the respective open and closed channels. In FIG. 9A, a pair of channel bodies 216A, 216B are provided at medial locations along the convex outer surface 204 of the support plate 144. The channel bodies 216A, 216B are wider than the relatively narrower channel bodies 216, 218 discussed above, but otherwise provide a pair of closed retention channels 220A, 222A as before.

Segmented sidewalls 210A, 212A form a first open retention channel 214A between channel body 216A and the right edge of the plate 202, and segmented sidewalls 210B, 212B form a second open retention channel 214B between the channel body 218A and the left edge of the plate 202. As before, the respective open and closed channels 214A, 214B, 220A and 222A provide a routing path along the convex outer surface for the strap 148.

FIG. 9B shows another configuration in which a single, large channel body 216B is disposed in a central location along the convex outer surface 204 to define a closed retention channel 220B. Segmented pairs of sidewalls 210C, 210C and 210D, 212D are provided to define open retention channels 214C, 214D on opposing sides of the channel body 216B. As before, this provides a routing path via open retention channels 214C, 214D and closed retention channel 220B. Any number of other arrangements can be used as desired. While the sidewalls have been shown as substantially planar elements, the sidewalls can take other forms such as the outer surfaces of posts, projections, tabs, clips, or other elements as required.

Figure 10:
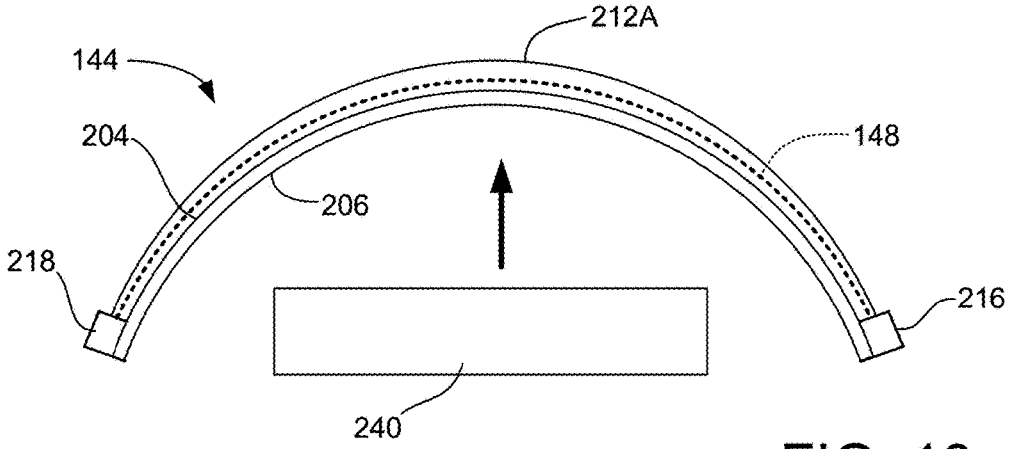
FIG. 10 is a side elevational view of the support plate in further embodiments.

FIG. 10 shows a side plan view of the support plate 144 in still further embodiments. In this case, tapered sidewalls (one shown at 212A) have a tapered height so as to be taller near medial portions of the support plate 144 and shorter near the respective ends of the support plate 144. Because the sidewalls as illustrated herein provide both lateral retention and support of the retention strap 148 as well as enhance the stiffness characteristics of the plate, various configurations of the sidewalls can be used with different profile characteristics. It will be noted that the flexibility of the plate may be provided to allow flexibility along multiple axes, including the ability to twist the plate to conform to the particular shape and size of the user's leg.

FIG. 10 also shows the support plate 144 to not have the foam blocks 208 (see e.g., FIGS. 3A, 6B, 6E) that are permanently, adhesively affixed to the concave inner surface 206 as previously discussed. Instead, FIG. 10 shows that such pads are optional and the support plate 144 can be used without such compliant material in situations where direct contact of the concave inner surface 206 against the user's leg is desirable.

Alternatively, a separate cushioning pad 240 can be interposed by the user between the concave inner surface 206 and the user's leg, as shown. In this way, the tensioned strap 148 will affix the pad 240 to the concave inner surface 206 and compress the pad against the user's leg once the strap is secured. The use of a separate, removable pad 240, however, allows a further range of adjustability since thicker/thinner pads, different styles and types of pads, pads made of different materials, etc. can be individually selected and used to maximize user comfort, stability and control. The separate, removable pad 240 can alternatively or additionally be used with the leg band 142 in lieu of or in addition to the permanently affixed blocks 168.

Figure 11:
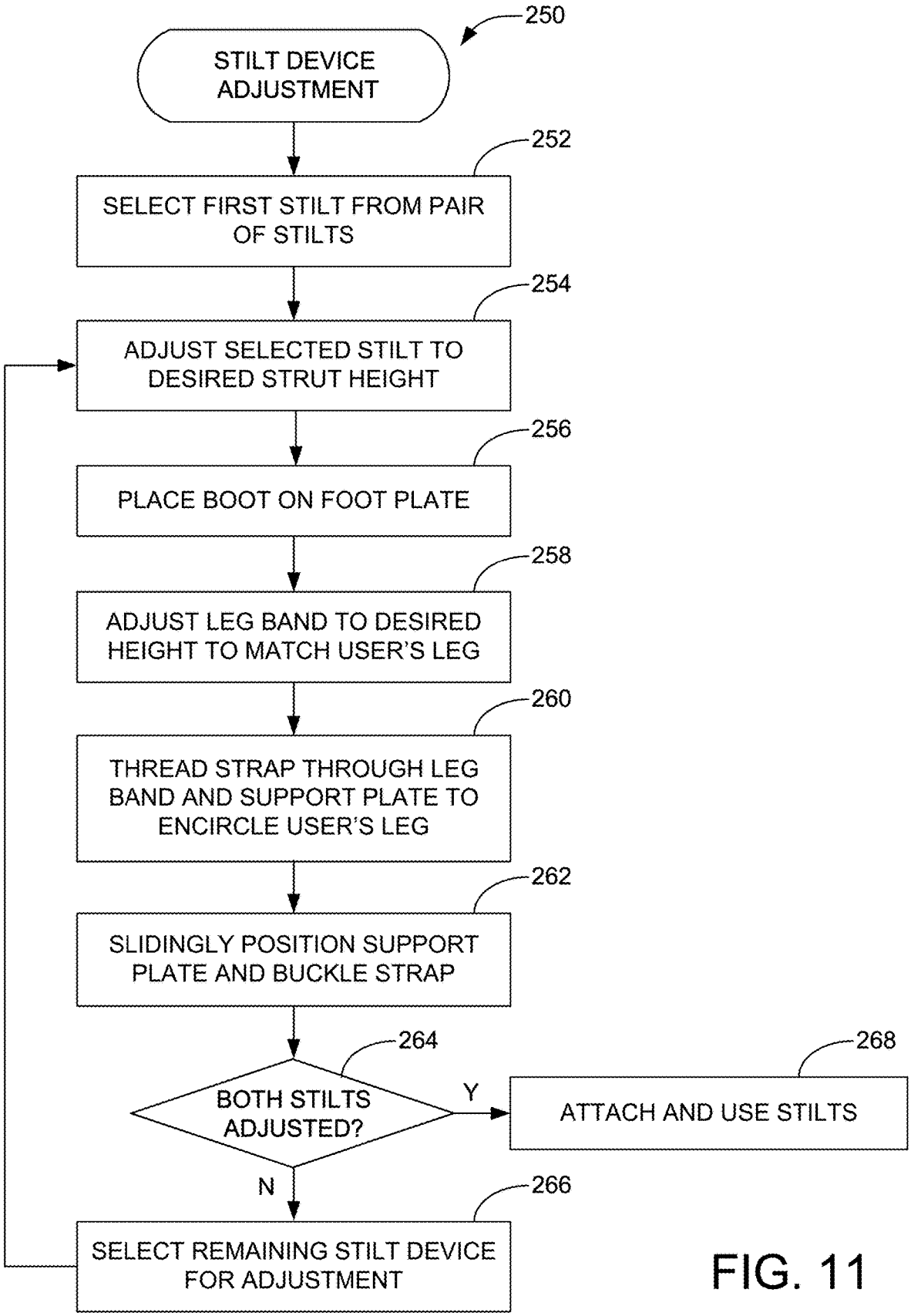
FIG. 11 is a flow chart for a stilt device installation and adjustment routine carried out in accordance with various embodiments to adjust a pair of stilts constructed and operated in accordance with various embodiments.

FIG. 11 provides a flow chart for a stilt device installation and adjustment routine 250 to illustrate operational steps that can be carried out in accordance with the foregoing discussion to adjust, attach and use a pair of stilts for a particular user with the leg attachment assembly as disclosed herein. It will be appreciated that the sequence 250 is merely exemplary and other steps can be carried out as desired depending on the requirements of a given application. The steps can be carried out by the user, alone or with the aid of an assistant.

The sequence 250 is carried out for each of a pair of stilt devices to be worn by the user; that is, the operations may be performed to adjust a first stilt, such as a left-side stilt, followed by the adjustment of the remaining second stilt, such as a right-side stilt. For safety purposes, it is advisable that the user sit in a chair or otherwise use a stable support surface during these adjustment and attachment operations.

A first stilt from the pair is selected at step 252, and the relative height of the selected stilt is adjusted as desired at step 254. If utilized, the height adjustment can be made via adjustments to the telescopic struts 106A/106B as illustrated above.

The user next secures the boot or other footwear to the selected stilt at step 256. This enables the user to adjust the leg band to the desired height so as to comfortably encircle the user's leg below the knee thereof, step 258.

Once the desired height and angle of the leg pole 122 is identified, the user proceeds at step 260 to thread the strap through the leg band 120, 144 and through the support plate, if the strap is not already routed through these elements. This may include passage of the tip 159 (FIG. 2A) through the leg band closed strap retention channel 174 of the leg band channel body 172 (see FIGS. 5A-5C), and passage of the tip 159 through the respective support plate closed strap retention channels 220, 222 of the support plate channel bodies 216, 218 (see FIGS. 7A-7C). The respective order and direction of the routing of the strap 148 through these channels will determine the final position for the buckle; a forward location as shown in FIG. 3B may be preferred for ease of access by the user.

Once the strap has been routed through the respective leg band 120, 142 and support plate 144 and encircles the user's leg, the routine continues at step 262 where the user slidingly positions the support plate 144 forward or backward along the strap to a desired position, and buckles the strap to secure the leg attachment assembly to the leg. If a separate pad such as 240 is desired, the user installs this as well during this part of the routine.

It will be noted that the support plate 144 serves to distribute the concentration of force supplied by the tensioned strap to a larger area by way of the cushioned plate, thereby enhancing user comfort, stability and control. Because the moveable support plate 144 is not secured to the leg band (or a separate leg pole, etc.), the support plate 144 can be moved relative to the leg band circumferentially about the user's leg to an optimum location. Once positioned, the tightened strap will tend to retain the support plate in the desired position along the strap.

While it is contemplated that in many cases the user will elect to position the support plate 144 so to be nominally centered on the strap (see e.g., FIG. 3A), a full range of sliding motion is available so that the support plate 144 can be brought into contacting abutment with either of the edges of the leg band.

While not shown in FIG. 8, other adjustments to the stilt device can be made by the user as well, including adjustments to the angle or other position of the leg pole (e.g., see clamp 116 in FIG. 1, etc.).

Once completed, the user repeats these steps for the remaining stilt device, as shown by steps 264 and 266. Once both stilts have been properly adjusted, the user can thereafter mount the stilts and proceed with standing and walking at the selected elevational height established thereby, step 268.

It will now be appreciated that the various embodiments disclosed herein provide a number of benefits over the existing art. The leg attachment assembly as embodied herein provides enhanced ranges of adjustability and security for the user.

The pivotable leg band (such as exemplified at 142) provides enhanced user comfort by conforming to the shape of the user's leg and is configured in such a way as to allow a standard, commonly used stilt leg strap to pass between the hinged pivot section of the clevis bracket arrangement and the padded comfort face of the leg band.

As noted previously, the strap pass-through section of the leg band is dimensionally configured to provide light friction on the strap, thereby preventing the strap and the strap tip from accidentally coming out and subsequent strap loss when not in use. The arrangement also provides fewer parts and reduces weight while maintaining the desired spacing between the support pole and the leg band.

The support plate (comfort pad such as exemplified at 144) provides additional comfort to the user by frictionally passing the strap through channel bodies and a central open channel on the backside of the plate so that the securement force supplied by the narrow strap is spread out to a larger contact surface provided by the plate.

Because the support plate is a separate element not otherwise attached to the stilt, the support plate can be slidingly advanced or retracted along the strap to optimize comfort to the user. The use of optional cushioning material interposed between the support plate and the user's leg, including but not limited to the permanently affixed foam block pads shown at 130, 168, 208 or the removably affixed pad 240, can further facilitate the interface between the stilt and the user.

Moreover, because the support plate is a separate element, the support plate can be used with the disclosed pivotable leg band 144, or can be added to an existing stilt device and used with a conventional leg band such as 120 to provide enhanced stability, comfort and control as compared to having the strap contact the user's leg directly as in the arrangement of FIG. 1.

Numerous possible variations and modifications will readily occur to the skilled artisan in view of the foregoing discussion, so it will be understood that the various exemplary embodiments disclosed herein are illustrative of, and are not limiting to, the scope of the claimed subject matter set forth below.

What is claimed is:

1. An apparatus, comprising:

a curved plate having a convex outer surface, an opposing concave inner surface, and opposing first and second edges;

first and second retention walls that extend upwardly from the convex outer surface to form an open strap retention channel that extends between the first and second edges;

a first channel body formed from third and fourth retention walls that extend upwardly from the convex outer surface and a transversely extending first web portion that extends between the third and fourth retention walls to form a first closed strap retention channel adjacent the first edge of the curved plate;

a second channel body formed from fifth and sixth retention walls that extend upwardly from the convex outer surface and a transversely extending second web portion that extends between the fifth and sixth retention walls to form a second closed strap retention channel adjacent the second edge of the curved plate, wherein the first and second closed strap retention channels are aligned with the open strap retention channel to facilitate sliding passage of a securement strap of a stilt device along a routing path that includes the first and second closed strap retention channels and the open strap retention channel.

2. The apparatus of claim 1, in combination with the securement strap of the stilt device having a buckle at a first end and a tip at the second end, wherein the tip is configured to be passed through the first closed strap retention channel, the open strap retention channel and the second closed strap retention channel to retain the curved plate on the securement strap.

3. The apparatus of claim 1, wherein the curved plate, the first and second retention walls, the first channel body and the second channel body are formed as an injection molded plastic article.

4. The apparatus of claim 1, further comprising a pair of spaced apart foam blocks affixed to the concave inner surface adjacent the respective first and second edges of the curved plate.

5. The apparatus of claim 1, further comprising a removeably affixable pad formed of compliant material and configured to be placed adjacent the concave inner surface of the curved plate.

6. The apparatus of claim 1, wherein the first and second retention walls are aligned with the third and fourth retention walls and with the fifth and sixth retention walls.

7. The apparatus of claim 1, characterized as a support plate for the stilt device, and wherein the apparatus further comprises a leg band affixed to a leg support pole, a wherein the securement strap is configured to encircle a leg of a user to secure the leg to the leg band, and wherein the securement strap extends from the leg band, through the respective first and second closed strap retention channels and the open strap retention channel, and back to the leg band, the support plate slidingly moveable along the securement strap relative to the leg band.

8. The apparatus of claim 7, wherein the leg band comprises:

a curved leg band plate having a convex leg band outer surface, a concave leg band inner surface, and opposing third and fourth edges;

a leg band channel body extending from a medial portion of the convex leg band outer surface of the curved leg band plate comprising seventh and eighth retention walls which extend upwardly from the convex leg band outer surface and which are adjoined by a transversely extending third web portion to form a leg band closed strap retention channel to accommodate sliding passage of the securement strap; and a bracket assembly comprising first and second ear brackets which extend upwardly from the third web portion to form a u-shaped clevis linkage arrangement with the leg support pole of the stilt device.

9. The apparatus of claim 8, wherein the curved leg band plate has a radius of curvature that matches a radius of curvature of the curved plate of the support plate.

10. The apparatus of claim 7, wherein the leg band, the securement strap and the support plate form a leg attachment assembly of the stilt device, and wherein the leg attachment assembly is affixed to the leg of the user by steps comprising:

encircling the leg of the user with the securement strap so that the concave inner surface of the support plate is interposed between the securement strap and the leg of the user;

tightening the securement strap to compressingly engage the support plate against the leg of the user; and slidingly advancing the support plate along the securement strap relative to the leg band.

11. An apparatus comprising:

a leg band affixable to a leg support pole of a stilt device;

a securement strap configured to encircle a leg of a user to secure the leg to the leg band; and a support plate configured to threadingly receive the securement strap, wherein:

the leg band comprises:

a curved leg band plate member having a first convex outer surface, a first concave inner surface, and opposing first and second edges;

at least one cushioning pad affixed to the first concave inner surface;

a leg band channel body extending from a medial portion of the first convex outer surface of the curved leg band plate member comprising first and second retention walls which extend upwardly from the first convex outer surface and which are adjoined by a transversely extending first web portion to form a leg band closed strap retention channel to accommodate sliding passage of the securement strap; and a bracket assembly comprising first and second ear brackets which extend upwardly from the first web portion to form a u-shaped clevis linkage arrangement with the leg support pole of the stilt device; and the support plate comprises:

a curved support plate member having a second convex outer surface, a second concave inner surface, and opposing third and fourth edges;

at least one cushioning pad affixed to the second concave inner surface;

third and fourth retention walls that extend upwardly from the second convex outer surface to form a support plate open strap retention channel that extends between the third and fourth edges; and a support plate channel body formed from fifth and sixth retention walls that extend upwardly from the second convex outer surface and which are adjoined by a transversely extending second web portion to form a support plate closed strap retention channel adjacent a selected one of the third or fourth edges and aligned with the open strap retention channel to facilitate sliding passage of the securement strap along a routing path that includes the support plate closed strap retention channel and the support plate open strap retention channel.

12. The apparatus of claim 11, wherein the securement strap extends from the leg band, through the respective support plate closed strap retention channel and the support plate open strap retention channel, and back to the leg band, the support plate slidingly moveable along the securement strap relative to the leg band to different circumferential locations about the leg of the user.

13. The apparatus of claim 11, in combination with the leg support pole and a fastener, wherein the fastener engages the first and second ear brackets of the bracket assembly to attach the leg band to the support pole and facilitate rotational movement of the leg band with respect to the leg support pole.

14. The apparatus of claim 11, wherein the support plate channel body is a first support plate channel body and the support plate closed strap retention channel is a first support plate closed strap retention channel, and wherein the support plate further comprises:

a second support plate channel body formed from seventh and eighth retention walls that extend upwardly from the second convex outer surface and which are adjoined by a transversely extending third web portion to form a second support plate closed strap retention channel adjacent a remaining one of the third or fourth edges and aligned with the open strap retention channel to facilitate sliding passage of the securement strap.

15. The apparatus of claim 11, wherein a void is formed in the first concave inner surface of the curved leg band plate member adjacent the leg band closed strap retention channel.

16. The apparatus of claim 14, wherein the curved leg band plate member has a radius of curvature that nominally matches a radius of curvature of the curved support plate member of the support plate.

17. The apparatus of claim 11, wherein the leg band, the securement strap and the support plate form a leg attachment assembly of the stilt device, and wherein the leg attachment assembly is affixed to the leg of the user by steps comprising:

encircling the leg of the user with the strap so that the second concave inner surface of the curved support plate member is interposed between the strap and the leg of the user;

tightening the securement strap to compressingly engage the support plate against the leg of the user; and slidingly advancing the support plate along the securement strap relative to the leg band.

18. The apparatus of claim 11, wherein the support plate closed strap retention channel is sized relative to the securement strap to provide friction-based retention of the support plate on the strap when the strap is in an unsecured configuration.

19. A stilt device of the type having a floor plate, a foot plate supported above the floor plate, a support pole extending upwardly from the foot plate, a leg band affixed to the leg support pole, and a securement strap configured to encircle a leg of a user to secure the leg of the user to the leg band while a foot of the user is supported on the foot plate, the improvement comprising:

a support plate configured to threadingly receive the securement strap to distribute a concentration of force supplied by the securement strap to a side of the leg opposite the leg band, the support plate slidingly positionable along the securement strap relative to the leg band and circumferentially about the leg of the user, the support plate comprising:

a curved support plate member having a convex outer surface;

a first closed strap retention channel extending from the convex outer surface;

a second closed strap retention channel extending from the convex outer surface; and an open strap retention channel aligned with the first closed strap retention channel and the second closed strap retention channel to define a routing path for the securement strap that passes through the respective first and second closed strap retention channels and the open strap retention channel.

20. The improvement of claim 19, wherein the first closed strap retention channel is adjacent a first end of the curved support plate member, and the second closed strap retention channel is adjacent an opposing second end of the curved support plate member.

21. The improvement of claim 19, wherein the open strap retention channel is disposed between the first closed strap retention channel and the second closed strap retention channel along the routing path.

22. The improvement of claim 19, wherein:

the open strap retention channel is formed from first and second retention walls that extend upwardly from the convex outer surface;

the first closed strap retention channel is defined by a first channel body comprising third and fourth retention walls that extend upwardly from the convex outer surface and a transversely extending first web portion that extends between the third and fourth retention walls; and the second closed strap retention channel defined by a second channel body comprising fifth and sixth retention walls that extend upwardly from the convex outer surface and a transversely extending second web portion that extends between the fifth and sixth retention walls.

* * * * *